United States Patent [19]

Ellis et al.

[11] 3,980,096

[45] Sept. 14, 1976

[54] FIRE HYDRANT

[75] Inventors: Daniel A. Ellis; Joseph L. Daghe, both of Decatur, Ill.

[73] Assignee: Mueller Co., Decatur, Ill.

[22] Filed: July 29, 1975

[21] Appl. No.: 600,192

[52] U.S. Cl. ..... 137/283; 137/307; 251/361

[51] Int. Cl.[2] ..... E03B 9/14

[58] Field of Search ..... 137/272, 282–285, 137/287–289, 291–308, 320–322; 251/361

[56] References Cited

UNITED STATES PATENTS

| | | | |
|---|---|---|---|
| 154,087 | 8/1874 | Roberts | 137/300 |
| 252,888 | 1/1882 | Mathews | 137/294 |
| 286,508 | 10/1883 | Vadersen et al. | 137/302 |
| 396,326 | 1/1889 | Carr | 137/285 |
| 551,919 | 12/1895 | Brown et al. | 137/283 |
| 2,083,319 | 6/1937 | Daviet | 137/299 |
| 2,555,727 | 6/1951 | Bolser | 137/303 |
| 2,633,143 | 3/1953 | Simon | 137/298 |
| 3,506,027 | 4/1970 | Dunton | 137/307 |

*Primary Examiner*—Martin P. Schwadron
*Assistant Examiner*—Richard Gerard
*Attorney, Agent, or Firm*—Cushman, Darby & Cushman

[57] ABSTRACT

A fire hydrant having a hydrant valve seat assembly positioned between the flanged lower end of the hydrant barrel and the flanged end of the hydrant shoe. The hydrant valve seat assembly and the hydrant valve element may be retained with the hydrant shoe when the hydrant barrel is removed and replaced or the hydrant valve seat assembly and the hydrant valve element, when in the closed position, may be retained with the hydrant barrel when the hydrant shoe is removed and replaced from the barrel. The fire hydrant includes an improved valve seat ring and seat ring housing, both of which may be made of brass so as to provide easy removal of the valve seat. The hydrant is provided with an improved drain valve facing strip for cooperating with the drain passage when the hydrant valve is open.

24 Claims, 23 Drawing Figures

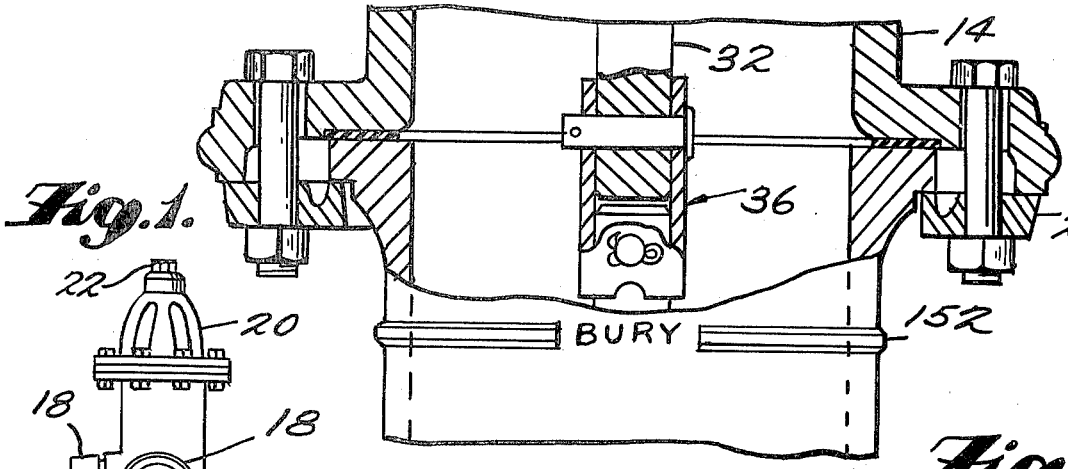
Fig. 1.
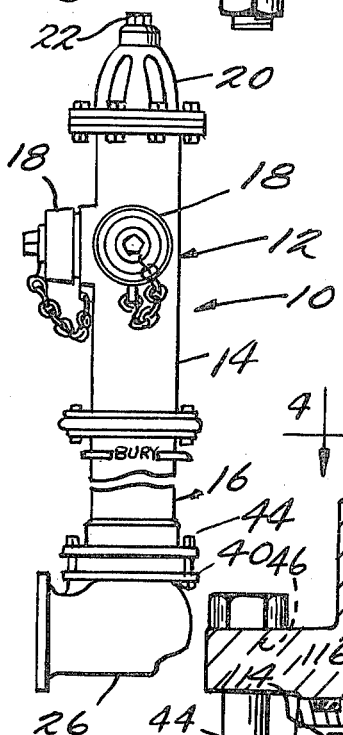
Fig. 2.
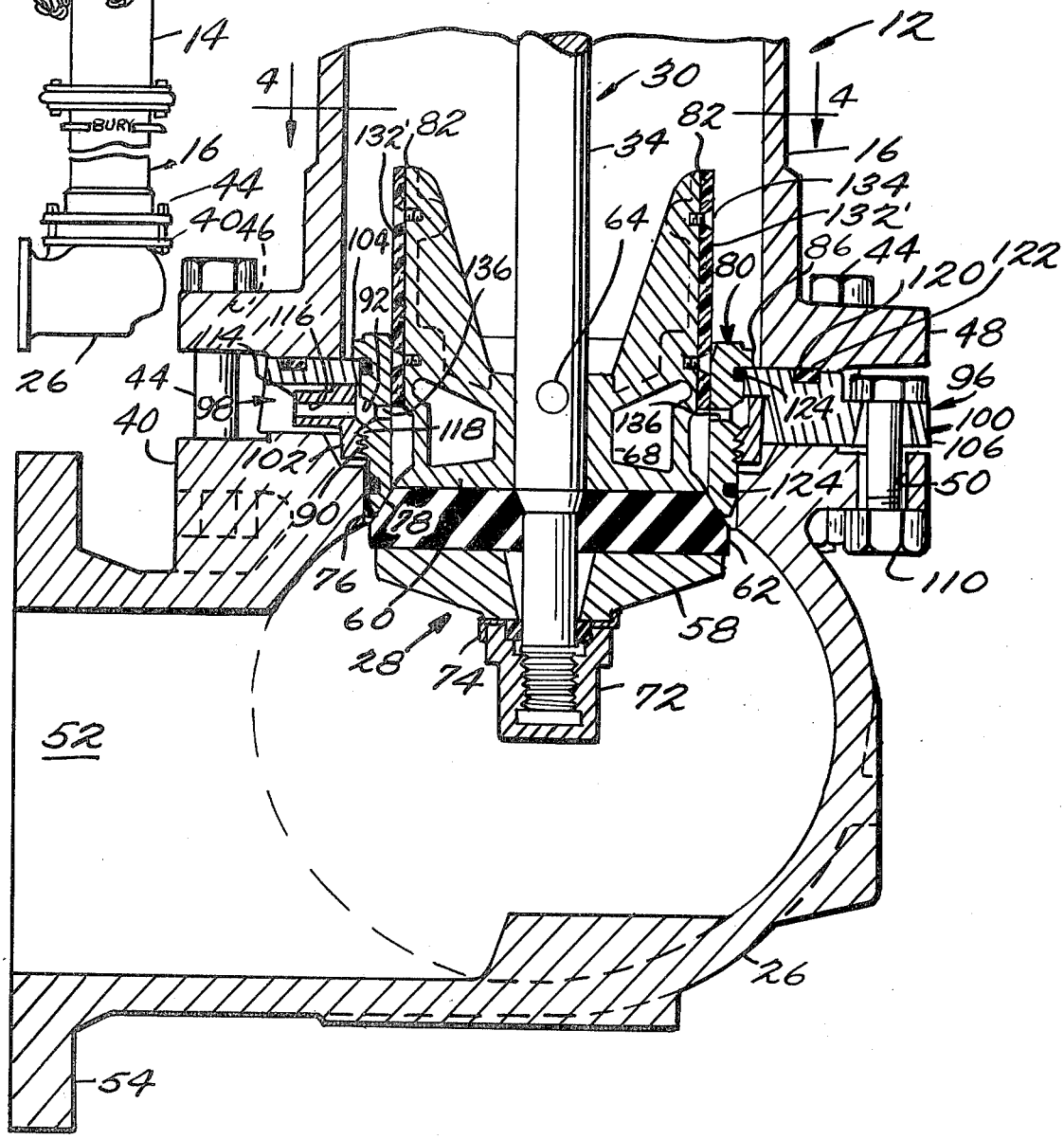

FIRE HYDRANT

The present invention relates to improvements in fire hydrants and, more particularly, to the arrangement of the support of the hydrant valve seat assembly and the hydrant valve element between the hydrant barrel and the hydrant shoe. The improved design construction enables the hydrant shoe to be replaced without removal of the valve seat assembly and valve element from the hydrant barrel and also enables the removal of the hydrant barrel from the hydrant shoe without the hydrant valve seat assembly and valve element being removed from the shoe. Additionally, the present invention provides for an improved drain valve facing strip for the hydrant as well as a drain valve passage which is protected from corrosion.

BACKGROUND OF THE INVENTION

For many years, fire hydrants have been constructed with their barrels made in two sections, an upper section and a lower section, the two sections being detachably connected to one another by frangible means which were normally positioned just above ground level. The lower barrel section, which had the major portion thereof buried, was connected to the hydrant shoe and usually the hydrant shoe was provided with a hydrant valve seat assembly threadably supported in the hydrant shoe. Some other prior constructions provided for the hydrant valve seat assembly being supported in the lower barrel section of the hydrant while in still other constructions the hydrant valve seat assembly was sandwiched between the hydrant barrel and the hydrant shoe but was connected both to the hydrant barrel and to the hydrant shoe so that it could not be retained with one or the other of the two elements mentioned when they were disassembled.

The difficulty with these prior hydrant constructions occurred when it was desirable to remove and replace a hydrant barrel from a hydrant shoe after the hydrant had been installed in a water distributor system or when a distributor wanted to remove a shoe from a hydrant and replace the shoe with another shoe having a different inlet configuration adaptable for a particular installation.

In installing hydrants, it is the usual practice to bury the lower portion of the hydrant to a bury line provided on the barrel of the hydrant. This positions the frangible connection between the lower barrel section and the upper barrel section of the hydrant at a location just above ground level. When a proper installation of a hydrant is accomplished, and the hydrant is subsequently struck by an automobile it is merely necessary to replace the upper hydrant barrel section without disturbing the lower barrel section or the hydrant shoe. However, as is often the case, hydrants are not properly installed and in some instances the frangible connection between upper and lower barrel sections is positioned too high above the ground during installation of the hydrant. With this type of installation, oftentimes the under carriage of a vehicle will hit and damage the lower barrel section necessitating replacement of the same along with possible replacement of the upper barrel section. In situations where the hydrant valve seat assembly was sandwiched between the lower barrel section and the hydrant shoe and held in place by both elements, it was necessary to turn off the water to the hydrant upstream of the same before repairs could be made as the hydrant valve seat assembly and valve element were not longer in place when the lower barrel section was removed from the shoe. Some prior art designs avoided this condition by threading or attaching the hydrant valve seat assembly directly to the hydrant shoe, but such an arrangement limited the interchangeability of a hydrant shoe from a hydrant barrel by the distributor when the necessity arose to change the hydrant shoe to provide a particular shoe inlet for a particular installation. The distributor not only had to remove the shoe from the hydrant barrel but also the hydrant valve seat assembly from the shoe if the same hydrant valve assembly was to be used in the reassembled hydrant. If this arrangement wasn't desirable, it meant the distributor had to stock each hydrant shoe having a different inlet size with a hydrant valve seat assembly and thus his inventory of shoes costs greater than if just the shoes by themselves were stocked.

For many years fire hydrants of the "dry" barrel type have been provided with drain valves for draining the hydrant barrel when the main hydrant valve is in the closed-position. These drain valves in the hydrants usually consisted of a drain passage from the exterior of the hydrant through the barrel or shoe and/or the valve seat assembly opening to the interior of the barrel at a point above the main hydrant valve. A leather strip carried by the moveable main valve element of the hydrant was arranged to close the opening of the drain passage when the valve element was moved to the open position. While the leather drain valve facing strips have given a somewhat satisfactory service, they did have the disadvantage of deteriorating in time and leaking after a certain number of cycles of operation. Efforts have been made more recently to improve the drain valve facing strips and in this respect rubber drain valve facing strips have been used. However, the rubber strips also have a disadvantage of "cold" flow and of deterioration from age.

In prior constructions of hydrants having drain valve passages therein, usually a portion of the passage was through the cast iron hydrant shoe or lower barrel section depending upon its location. The cast iron passage often corroded after a period of time and blocked the drain passage thus rendering the same useless.

In other prior constructions of hydrants, the hydrant seat ring was usually made of brass and was externally threaded so that it could be received in internal threads provided in the hydrant shoe or the hydrant lower barrel section. Since the lower barrel section or the shoe are made of cast iron, the cast iron threads of these elements would be mating with brass threads of the valve seat ring. Consequently, due to corrosion of the cast iron in time, the removal of the valve seat ring was made difficult.

PRIOR ART

Prior art relating to hydrants and in particular to the shoe barrel construction and drain valve are as follows:

| NUMBER | NAME | DATE |
|---|---|---|
| 154,087 | C. H. ROBERTS | Aug. 11, 1874 |
| 286,508 | W. VADERSEN ET AL. | Oct. 9, 1883 |
| 396,326 | C. CARR | Jan. 15, 1889 |
| 551,919 | J. L. BROWN ET AL. | Dec. 24, 1895 |
| 2,555,727 | W. W. BOLSER | June 5, 1951 |
| 2,633,143 | C. H. SIMON | Mar. 31, 1953 |

-continued

| NUMBER | NAME | DATE |
|---|---|---|
| 3,506,027 | J. T. DUNTON | Apr. 14, 1970 |

BRIEF SUMMARY OF THE INVENTION

Broadly stated, the present invention relates to an improvement in a fire hydrant and more particularly to the improved design arrangement for connecting the flanged lower end of the hydrant barrel to the flanged end of the hydrant shoe with the hydrant valve seat assembly positioned therebetween. The hydrant valve seat assembly includes a valve seat ring having an annular downwardly facing seat whereas the valve element carried on a valve stem extending upwardly through the mouth of the shoe and through the barrel seats upwardly against the annular downwardly facing seat. Means are provided for detachably connecting the flanged lower end of the hydrant barrel to the flanged end of the shoe and further means are provided, which are independent from the last-mentioned means, for detachably connecting the valve seat assembly to the flanged end of the shoe independently of the barrel.

The arrangement just described permits the barrel to be removed from the shoe without removing the valve seat assembly and the valve element from the shoe and it also permits removal of the shoe from the barrel without removal of the valve seat assembly and valve element from the barrel. The latter function occurs when the coupling means for coupling the valve seat assembly to the flanged end of the shoe is removed and when the valve element is seated against the valve seat. This arrangement has particular utility both before and after installation of the fire hydrant in a water distribution system. With regard to its utility prior to installation of the fire hydrant, the distributor may stock a number of different types of shoes having different inlets for different types of connections to water mains. When a hydrant is to be installed and if a shoe provided with the hydrant is not the particular type needed for the installation, then the distributor can remove just the shoe from the barrel of the fire hydrant by detaching the shoe from the barrel and by detaching the valve seat assembly from the shoe with the valve element in the closed position so that the valve seat assembly can stay with the barrel. A shoe having the proper inlet can then be installed in a reverse manner.

If the fire hydrant is improperly installed at its site of use so that its "bury" line is too high above the ground and its frangible coupling means between the barrel's lower section and upper section is too high above the ground, and subsequently, the fire hydrant is hit by a vehicle and the lower barrel section is damaged by the under carriage of the vehicle, the lower barrel section may be removed from the shoe without removing the valve seat assembly and valve element from the shoe as the valve seat assembly will be retained on the shoe by the means of detachably retaining these two elements together independent of the barrel. This feature enhances repair and also avoids the necessity of turning the water off upstream of the damaged fire hydrant.

The hydrant valve seat assembly which is sandwiched between the flanged lower end of the barrel and the flanged end of the shoe may include an annular housing ring having radially outwardly extending apertured lugs or ears through which bolt means extend and connect the same to the flanged end of the shoe independent of the flanged end of the barrel and an annular drain ring positioned between the housing ring and the hydrant shoe and a valve seat ring threadably received in the drain ring, the drain ring and the valve seat ring both being brass. The drain passage through the drain ring and the seat ring is, thus, an entirely brass passage which will not corrode and of course, the seat ring may be easily removed because there are brass threads cooperating with brass threads in these two elements.

Additionally, the hydrant valve seat assembly rather than being a three piece assembly, may be a two piece assembly wherein the housing member functions as a combination of the housing ring and the annular drain ring, this element receiving the valve seat ring.

The hydrant of the present invention is provided with improved drain valve facing strips carried by the main valve element, the improved strips being made of polyethylene and capable of improved sealing and longer life.

BRIEF DESCRIPTION OF THE DRAWINGS

FIG. 1 is a side elevational view of a fire hydrant embodying the present invention.

FIG. 2 is a fragmentary vertical view on an enlarged scale of the lower portion of the hydrant in FIG. 1, the view illustrating the frangible coupling between the upper and lower sections of the barrel and the novel connection between the lower end of the barrel and the shoe with the housing ring and the annular drain ring being shown in two radial planes for purpose of clarity.

DETAILED DESCRIPTION OF INVENTION

Figure 3:
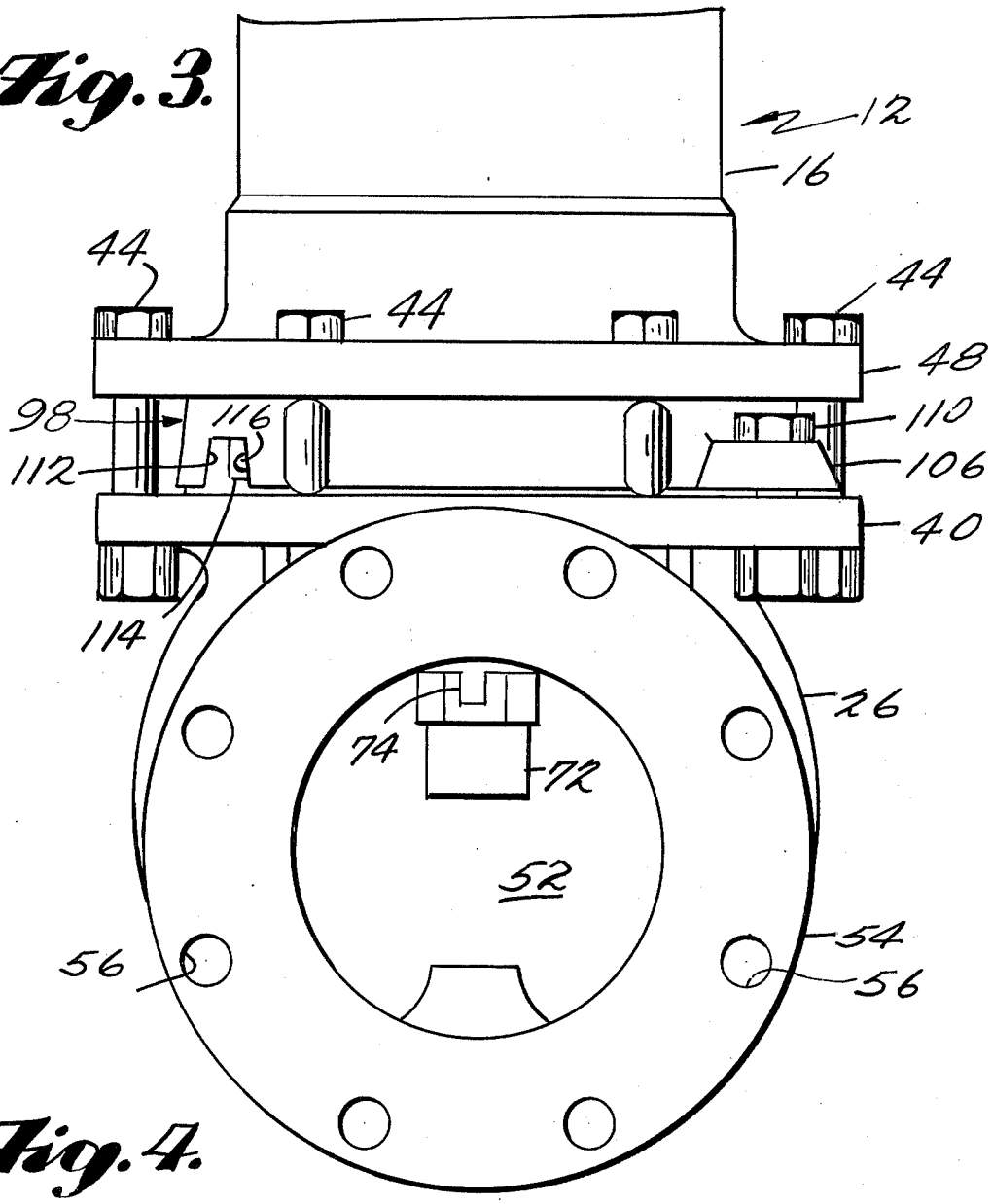
FIG. 3 is a fragmentary end elevational view of the lower portion of the hydrant looking from the left to the right of FIG. 1.

Referring now to the drawings wherein like characters and reference numerals represent like or similar parts there is disclosed, in FIG. 1, a fire hydrant generally designated at 10 and having a barrel 12 which is of the sectional type including an upper barrel section 14 and a lower barrel section 16. The upper barrel section 14 has the usual nozzles 18 and is provided with a bonnet or cap 20 through which extends the operating nut 22. Upper barrel section 14 is connected to the lower barrel section 16 by a frangible connecting ring 24. A hydrant shoe 26 is connected to the lower end of the lower barrel section 16 as will be described in more detail later in the specification.

The fire hydrant 10 is provided with a main hydrant valve generally designated at 28, the main hydrant valve being carried on a lower end of a valve stem 30 which extends upwardly through the barrel 12, the upper end of the barrel stem 30 being operatively connected to the operating nut so that when the operating nut is rotated the valve stem reciprocates vertically. Valve stem 30 is made up of upper and lower sections 32 and 34, respectively, the sections being coupled together by a frangible stem coupling generally indicated at 36, the stem coupling being of the type disclosed in the U.S. Pat. No. 3,439,947 issued Apr. 22, 1969 to Luckenbill et al. and having a common assignee as the present invention.

Figure 4:
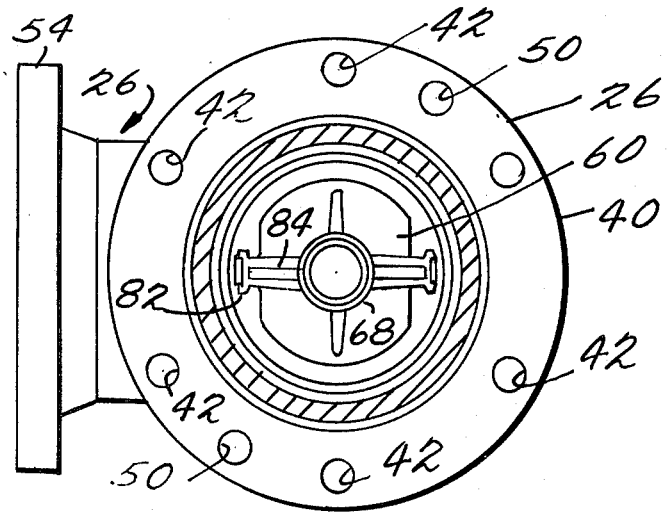
FIG. 4 is a sectional view taken substantially on the line 4—4 of FIG. 2, the view being on a reduced scale.

In more detail, the hydrant shoe 26 is provided with an upwardly opening mouth surrounded by a peripheral flange 40, the flange 40 having circumferentially spaced bolt holes 42 (FIGS. 4 and 9) for receiving bolts 44 extending through similar aligned holes 46 in a peripheral flange 48 on the lower end of the lower barrel section 16. The flange 40 is also provided with a pair of oppositely disposed bolt holes 50 for receiving the bolt means 110 as will be described in more detail later in the specification. Shoe 26 has an inlet 52 surrounded by a peripheral flange 54, the peripheral flange 54 having a plurality of circumferentially spaced bolt holes 56 (FIG. 3) so that the shoe may be connected to the flanged end of a supply pipe or water main (not shown). Depending on the locality, the mains to which the shoe 26 are attached may have different size flanges or different spaced holes or require other types of connecting means and consequently a distributor must keep in stock either a number of different size hydrants or as in the present invention a number of shoes having different size or shape inlets which can be interchanged with those on hydrants in stock.

Figure 10:
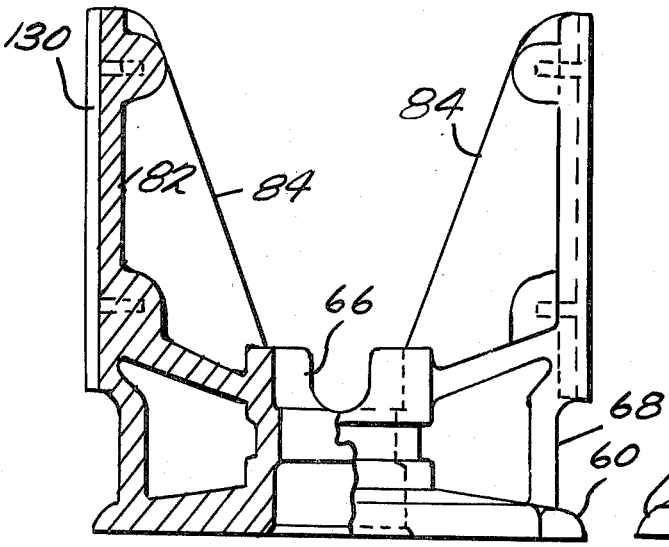
FIG. 10 is an enlarged side elevation, partly in vertical section and illustrating the upper valve plate for the main hydrant valve.

The main hydrant valve 28 which is mounted on the lower end of the valve stem 30 includes a lower valve plate 58, an upper valve plate 60 and a one piece annular rubber or rubber-like valve element 62 clamped therebetween. In this respect, the valve stem 30 is provided with a radially extending pin 64 which is received in a cut-out 66 on the web structure 68 of the upper valve plate 60 (FIG. 10). The lower end of the valve stem 30 extends through the upper valve plate 60, the valve element 62 and lower valve plate 58 and is threaded as indicated at 70 so that it may receive a cap nut 72 which clamps the upper valve plate 60, valve element 62 and lower valve plate 58 together. Preferably, a lock washer 74 having bendable outer flanges is interposed between the nut 72 and the lower valve plate 58.

Figure 11:
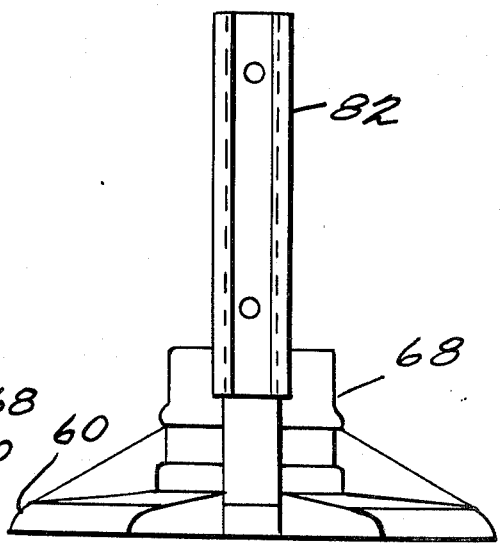
FIG. 11 is an elevational view looking from the left to the right of FIG. 10.

It will be noted that the main hydrant valve 28 has a maximum diameter less than the diameter of the mouth of the shoe 26 so that it can be inserted through the mouth of the shoe. The valve element 62 has a frusto-conical upwardly facing surface 76 which is arranged to cooperate with a downwardly facing frusto-conical valve seat 78 provided on an annular brass valve seat ring 80. Additionally, it will be noted that the web structure 68 on the upper valve plate 60 is provided with a pair of upwardly extending longitudinal ribs 82 reinforced by longitudinally extending stiffening ribs 84 (FIGS. 10 and 11).

Figure 6:
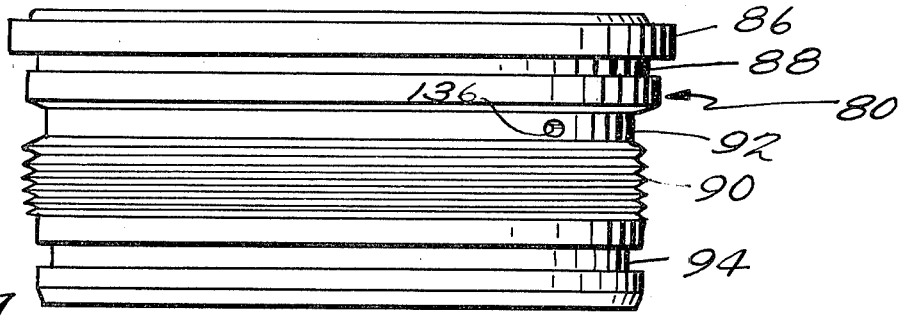
FIG. 6 is an enlarged side elevational view of the valve seat ring of the hydrant valve seat assembly.
Figure 7:
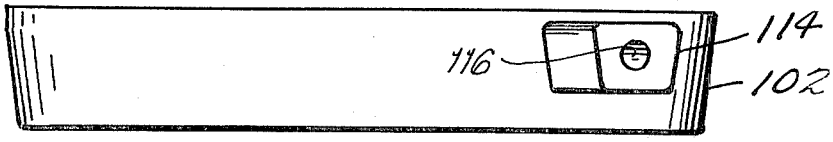
FIG. 7 is an enlarged side elevational view of the annular drain ring of the hydrant valve seat assembly.

The annular brass valve seat ring 80 is provided with a peripheral flange 86 about its upper end, an annular sealing ring groove 88 beneath the flange 86 and exterior threads 90 below an annular drain manifold groove 92 (FIG. 6). Below the exterior threads 90 there is a further annular sealing ring groove 94. As heretofore indicated under the heading BACKGROUND OF THE INVENTION valve seat rings of prior hydrants were either supported directly by the shoe or by the lower barrel section and, in some instances, were supported merely by sandwiching them between the peripheral flange on the lower section of the barrel and the peripheral flange extending about the mouth of the shoe. In the present case, a novel means is provided for supporting the valve seat ring whereby the valve seat ring 80 and the main valve 28 may be retained with either the shoe 26 or the hydrant barrel 12 depending upon certain circumstances.

Figure 5:
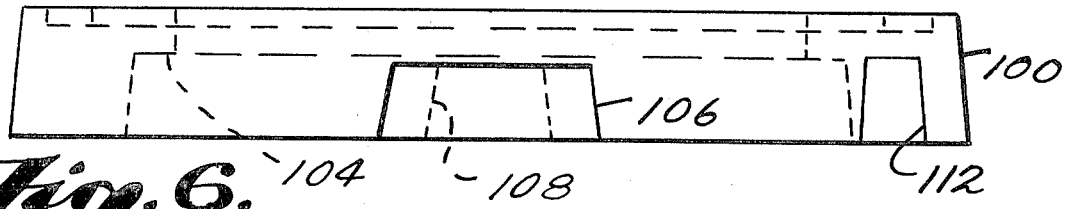
FIG. 5 is an enlarged side elevational view of the housing ring of the hydrant valve seat assembly.
Figure 8:
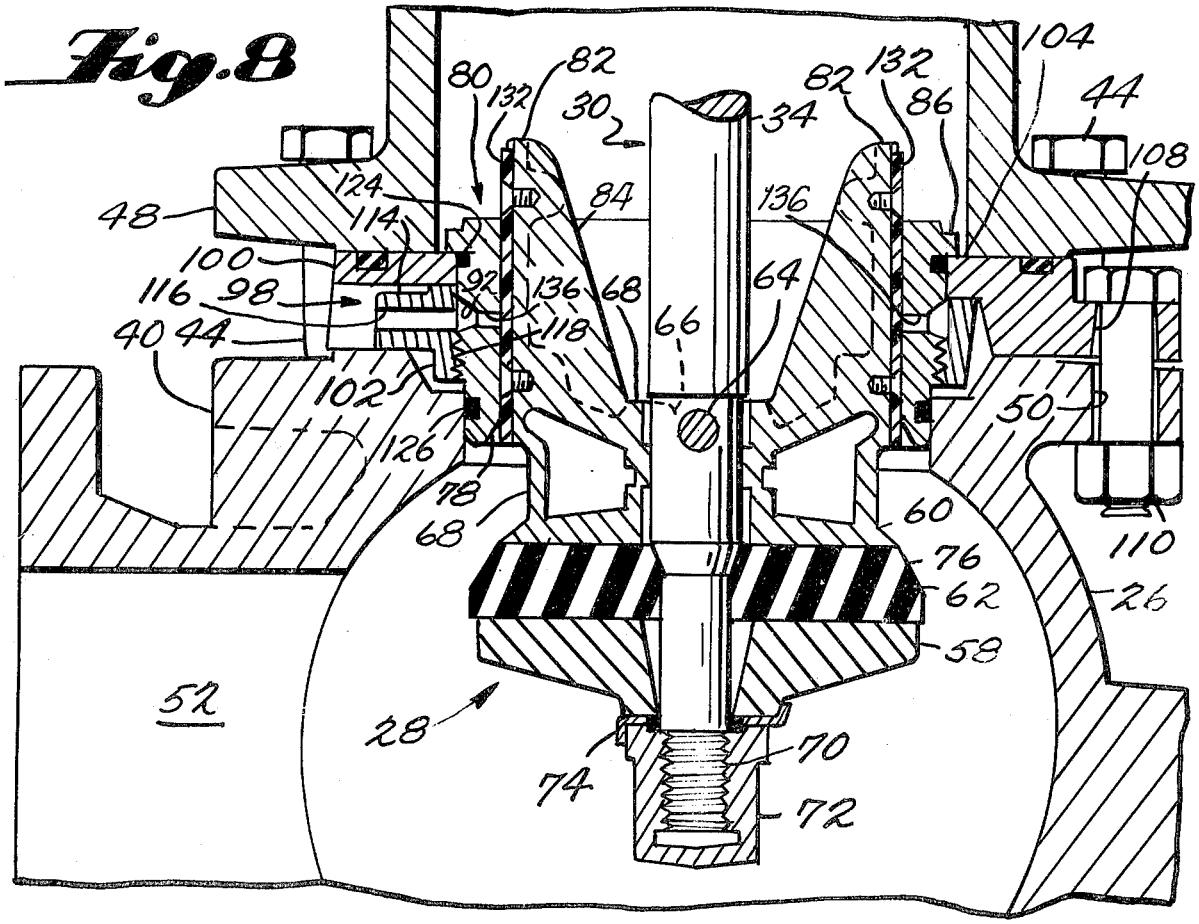
FIG. 8 is a fragmentary vertical sectional view similar to the lower portion of FIG. 2 but illustrating the hydrant valve element in the open position.

In more detail, a hydrant valve seat assembly generally designated at 96 is provided and this hydrant seat assembly includes the valve seat ring 80, and a housing member 98 which as shown in FIGS. 2 and 8 includes an annular housing ring 100 and an annular drain ring 102 made of brass. The housing ring 100 (FIG. 5) is provided with a radially inwardly extending flange 104 against which the flange 86 of the seat ring 80 abuts. Additionally, the annular housing ring 100 is provided with two oppositely disposed radially extending lugs or ears 106 (FIG. 9), the lugs or ears 106 being of less thickness than the total thickness of the housing ring 100. Each of the lugs or ears 106 is provided with an aperture 108 which is arranged to align with the apertures 50 in the peripheral flange 40 of the shoe 26. Bolt means 110 extending through the apertures 108 and 50 retain the housing ring 100 on the shoe 26 when sandwiched between the lower end of the hydrant barrel 12 and the shoe 26. The housing ring 100 further is provided with a pair of radially extending oppositely disposed cut-outs 112 in its lower surface.

Figure 9:
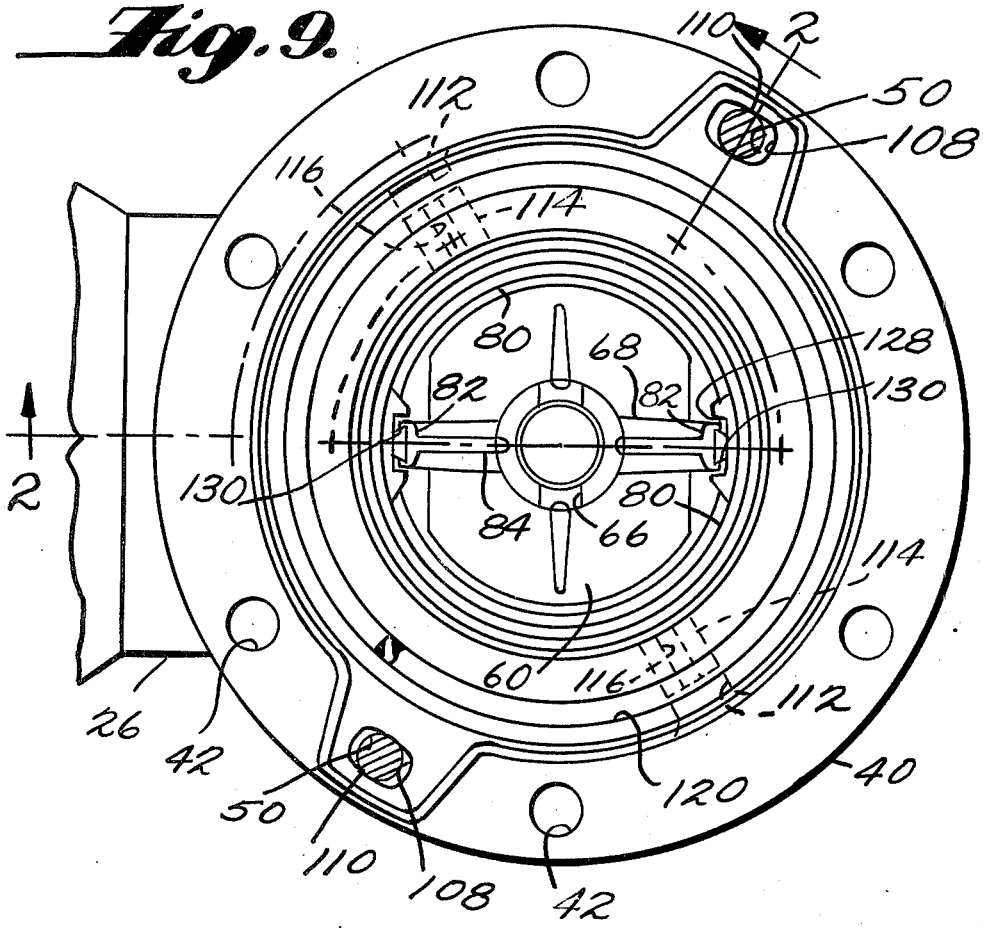
FIG. 9 is a top plan view of the shoe and the hydrant valve seat assembly of FIG. 2, the lower section of the barrel being removed.

The drain ring 102 is arranged to abut the flange 104 of the annular housing ring 100, and when positioned as shown in FIGS. 2, 8 and 9, a pair of oppositely disposed lugs or ears 114, which extend radially outwardly from the annular drain ring 102 extend into the cutouts 112 of the housing ring 100 and thus prevent the drain ring 102 from rotating relative to the housing ring. Each of the lugs or ears 114 is provided with a drain passage 116 therethrough which communicates with the annular manifold 92 of the seat ring 80. The annular drain ring 102 is interiorly threaded as indicated at 118 and thus it is arranged to receive the exterior threads 90 of the seat ring 80. It should be noted that since both the annular drain ring 102 and the seat ring 80 are made of brass, there is brass to brass threads between the two elements making removal of the seat ring easier because of less corrosion problems. Also, the drain passages through the drain ring 102 and the seat ring 80 are brass and, thus, not as likely to become clogged by corrosion.

The upper surface of the housing ring 100 is provided with an annular groove 120 which receives a sealing element 122. Sealing element 122 seals the interior of the barrel 12 from the exterior of the hydrant 10. A sealing ring 124 is provided in the annular groove 88 of the valve seat ring 80 whereas a second sealing ring 126 is provided in a groove 94 of the valve seat ring 80, the sealing rings 124 and 126 providing seals on either side of the drain passages 116 respectively between the housing ring 100 and the valve seat ring 80 and between the mouth of the shoe 26 and the seat ring 80.

Annular seat ring 80 as best shown in FIG. 9 is provided with a pair of oppositely disposed and facing longitudinally extending grooves 128 for receiving the ribs 82 of the upper valve plate 60 and, thus, when the valve 28 is reciprocated, it cannot rotate relative to the seat ring. Additionally, it will be noted that the ribs 82 are each provided with a dovetail longitudinally extending groove 130 which receives an elongated drain valve facing strip 132 having generally a cross-sectional configuration complementary to the groove. The drain valve facing strips 132 are secured to the ribs by bronze, stainless steel or other suitable corrosion resistant screws 134. The valve seat ring 80 has a pair of oppositely disposed drain passages 136 therein which communicate with the annular manifold 92. As shown in FIG. 2, the main valve 28 is closed and when the main valve is in this position, the drain passages 136 in the valve seat ring 80 are open to the interior of the barrel 12 above the valve 28 and thus any water in the hydrant can drain through the passages 136 to the manifold 92 and through the passages 116 to the exterior of the hydrant. However, when the main valve 28 is in the opened position as shown in FIG. 8, the drain valve facing strips 132 moving with the ribs 82 cover the drain passages 136 so that water passing through the shoe and barrel cannot escape through the drain passages to the exterior of the hydrant.

Figure 12:
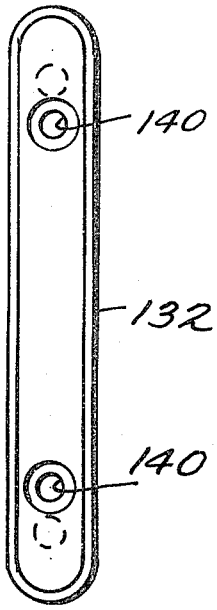
FIG. 12 is an enlarged view of one form of drain valve facing strip looking at the side which seals against the drain passage in the hydrant valve seat assembly.
Figure 13:
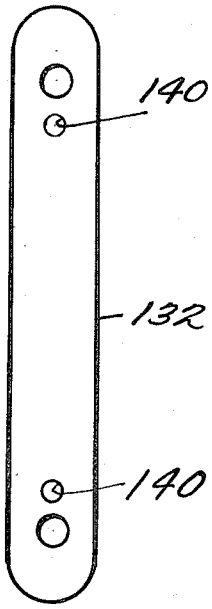
FIG. 13 is a view of the drain valve facing strip of FIG. 2 but looking at the opposite side thereof.
Figure 14:
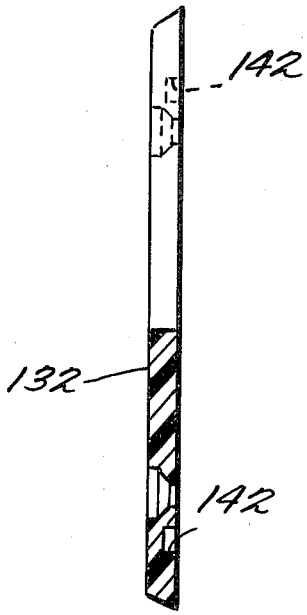
FIG. 14 is a side elevation of the drain valve facing strip, the view being partly in vertical section.
Figure 15:
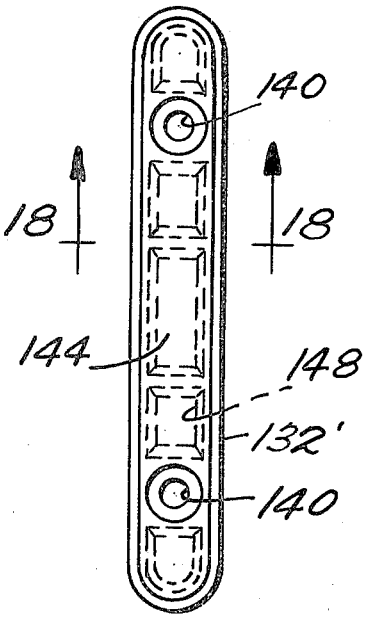
FIGS. 15, 16 and 17 are views similar to FIGS. 12, 13 and 14, respectively, but showing a modified configuration of a drain valve facing strip.
Figure 16:
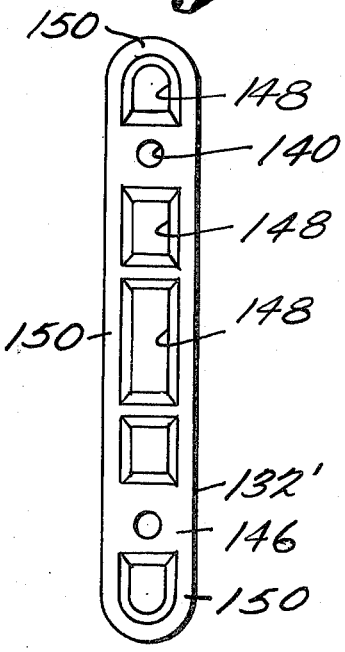
Figure 17:
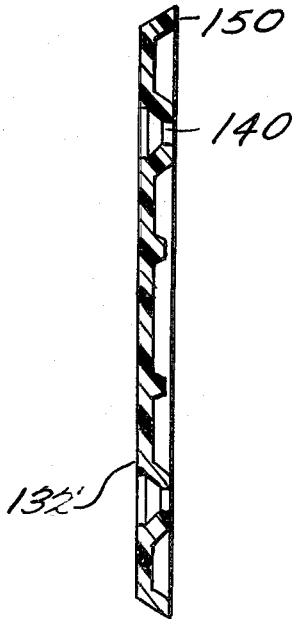
Figure 18:
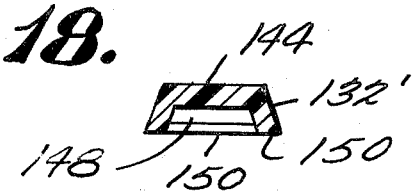
FIG. 18 is a sectional view taken on the line 18—18 of FIG. 15.
Figure 19:
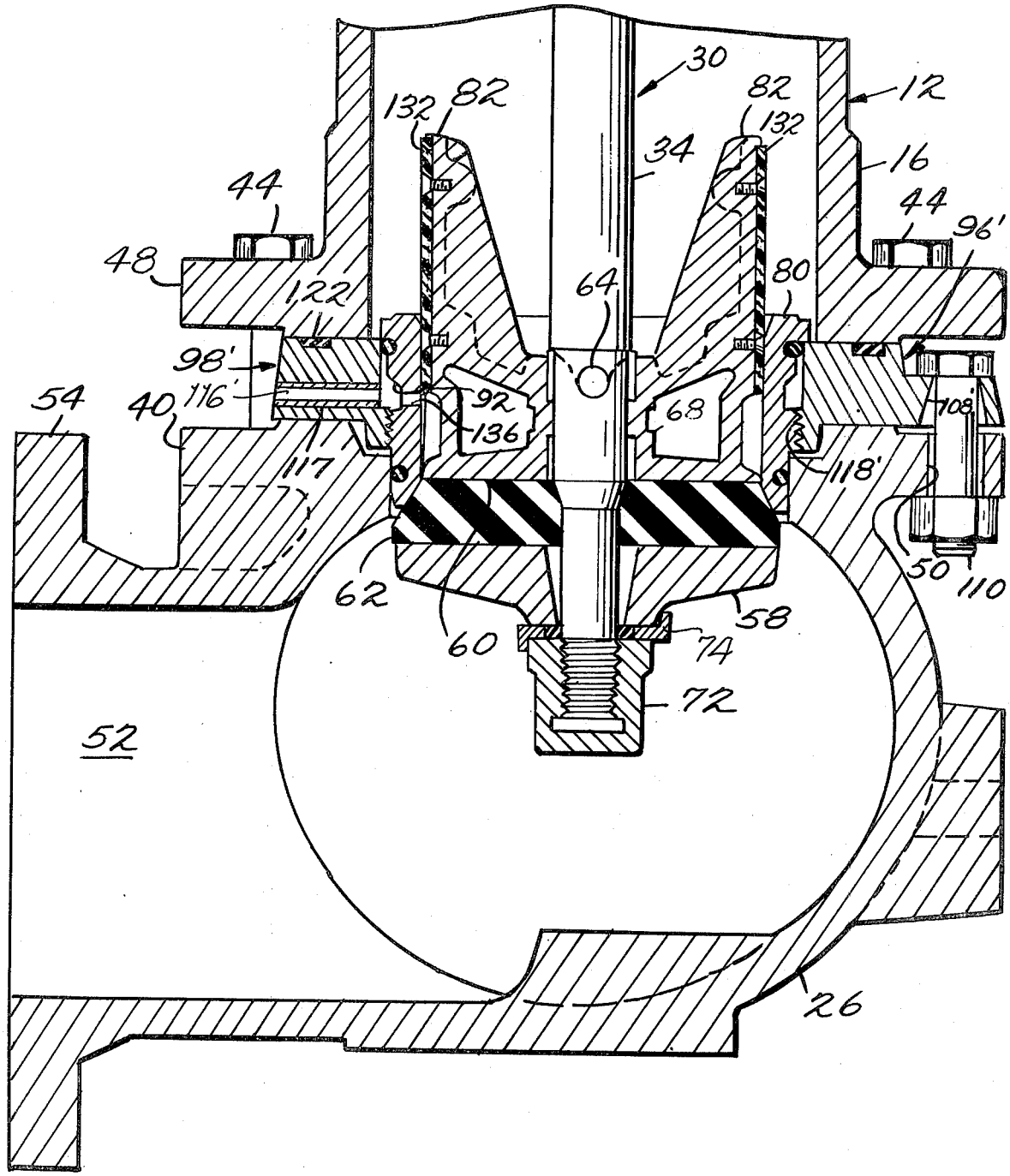
FIG. 19 is a vertical sectional view similar to FIG. 2 but illustrating a modified form of hydrant valve seat assembly.
Figure 20:
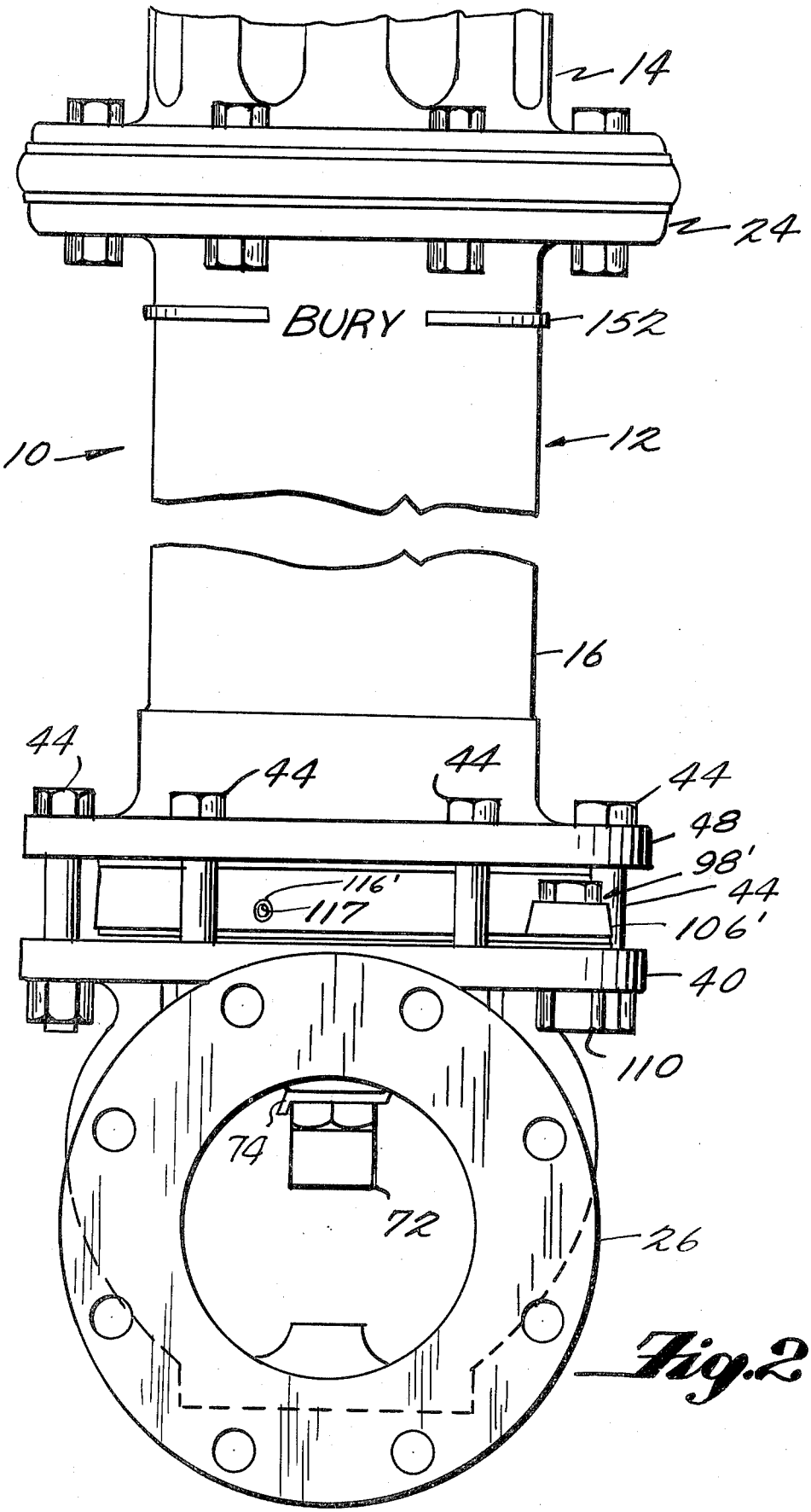
FIG. 20 is an elevational view looking from the left to the right of FIG. 19, the view being shown on the reduced scale.

As shown in FIGS. 12 through 14 the elongated drain valve facing strip 132 is a molded polyethylene strip of solid configuration in cross-section, the polyethylene being PE 2306. The strip is molded with apertures 140 therethrough for receiving the bronze, stainless steel or other suitable corrosion resistant screws 134. The back surface of the solid polyethylene drain valve facing strip 132 may be provided with small depressions 142, these depressions resulting from locating pins in the mold but these depressions have no other function.

FIGS. 15 through 18 disclose a slightly modified drain valve facing strip 132'. While the front surface 144 of the drain valve facing strip 132' is planar, it will be noted that the back surface 146 is provided with a plurality of dish-shaped recesses 148, the recesses being completely sealed against the surface of the groove 130 by the peripheral border 150 of the back surface of the strip.

Leather drain valve facing strips were used for many, many years. However, the leather drain valve facing strips have several drawbacks in their use on hydrants such as cost of manufacture, sizing and quality control. Another disadvantage of the leather drain valve facing strips is that there was considerable leakage past the same, especially after use of the hydrant. It has been found that by making the drain valve facing strips of solid polyethylene 2306 such as shown in FIGS. 12 to 14, or a polyethylene drain valve facing strip with a recessed back there was marked improvement over the leather. In fact, the recessed back polyethylene 2306 drain valve facing strip of the type shown in FIGS. 15 through 18 were even superior to the solid polyethylene drain valve facing strip because the facing had more resilience or flexural shape that allowed for better sealing throughout the range of minimum to maximum squeeze on the facings even after continued cycling of the hydrant. Both types of polyethylene drain valve facing strips 132 and 132' were cheaper to manufacture and have a more accurate shape than the leather drain valve facing strips.

Tests have been run to prove the superiority of both types of polyethylene 2306 drain valve facing strips over leather drain valve facing strips and the results of these tests are as follows:

| Type of Facing | Average Leakage in CC/5 minutes 0 Cycles | 100 Cycles | 1000 Cycles |
|---|---|---|---|
| Recessed PE 2306 | .63 | 1.25 | 1.05 |
| Solid PE 2306 | 15.6 | 177.5 | 212.5 |
| Leather | 31.5 | 315. | NA* |

*Test stopped before 1000 cycles because leakage too great to continue.

As shown in FIGS. 1 and 2, the lower barrel section 16 of the barrel 12 is provided with a bury line 152 positioned just below the upper end of the section 16. If the hydrant 10 is properly installed with the ground line adjacent the bury line 152, and if the hydrant is struck by a vehicle, the frangible connection between the lower section 16 and the upper section 14 as well as the frangible coupling 36 will break without damage to the lower section or the shoe. However, oftentimes installation crews do not properly install the hydrants and the bury line 152 is sometimes positioned a considerable distance above the ground line. In situations such as this, when the hydrant is struck by a vehicle, the upper barrel section 14 will be sheared from the lower barrel section but the under carriage of the vehicle sometimes damages the upper end of the lower section 16 of the barrel 12. When this occurs, the lower section 16 of the barrel 12 may be removed from the shoe 26 by merely removing the bolt means 44 which attach this section to the shoe. Since the bolt means 110 attaching the hydrant valve seat assembly 96 do not extend through the flange 48 but are completely independent thereof, the hydrant valve seat assembly will be retained on the shoe 26. With the valve 28 in the closed position no water will escape from the water main and necessary repairs can be made by replacing the damaged lower barrel section with a new section.

Generally speaking hydrants are shipped by the manufacturer to the distributor as a complete unit, with the shoe attached thereto. The distributor usually had other shoes in stock to fit a particular hydrant but having a different inlet configuration for particular installations. When the situation arose when it was necessary to remove the shoe off of a hydrant and replace it with a shoe having a different inlet, the entire valve assembly had to be removed from the shoe before the shoe could be replaced. In the present invention this condition is obviated because the shoe 26 can be removed without removing the valve 28 or the hydrant valve seat assembly 96. When the shoe 26 is to be replaced, the bolt means 44 are removed as well as the bolt means 110 and with the valve 28 in the closed position so that the valve element 62 is bearing upwardly on the valve seat 78, the shoe can then be removed as the hydrant valve seat assembly 96 will be retained with the hydrant barrel 12. In this respect, the seat ring 80 is threaded to the drain valve ring 102 and the drain valve ring 102 bears upwardly against the flange 104 of the housing ring 100 and this maintains the housing ring 100 against the lower end of the barrel section 16.

Referring now to FIGS. 19 through 23 inclusive, there is disclosed a modification of the hydrant of the present invention. In this respect, all elements which are identical to those described with respect to FIGS. 1 through 18 will be given the same numerals as in the description of FIGS. 1 through 18.

Figure 21:
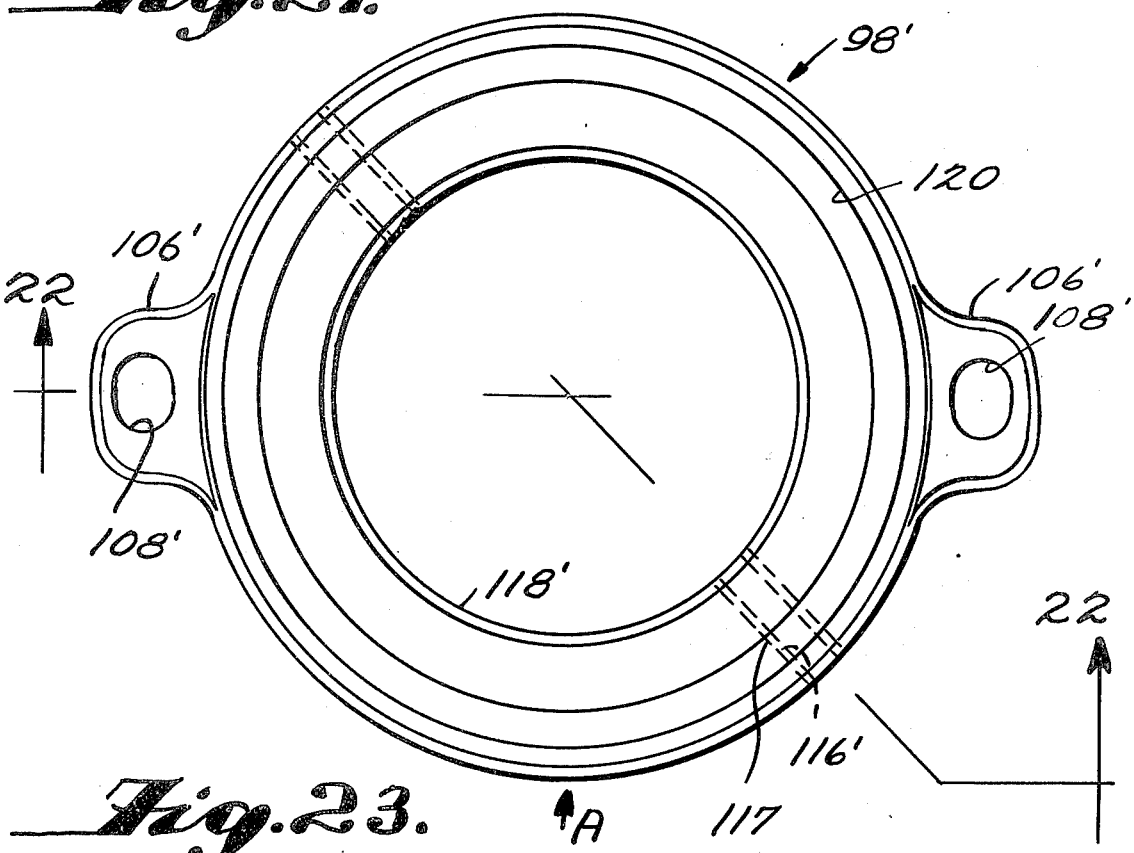
FIG. 21 is a top plan view disclosing an annular housing member of said hydrant valve seat assembly of FIG. 19.
Figure 23:
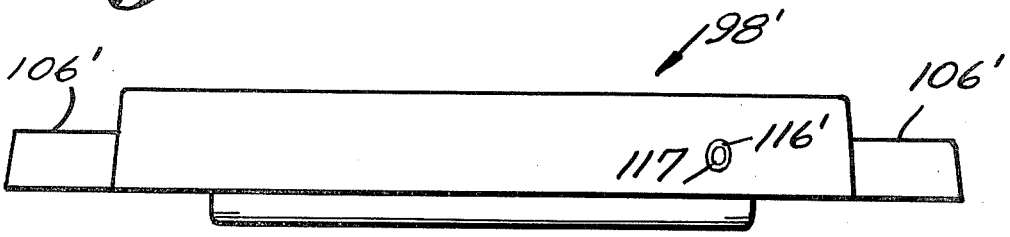
FIG. 23 is a side elevational view of the housing member of FIG. 21 looking in the direction of the arrow A.
Figure 22:
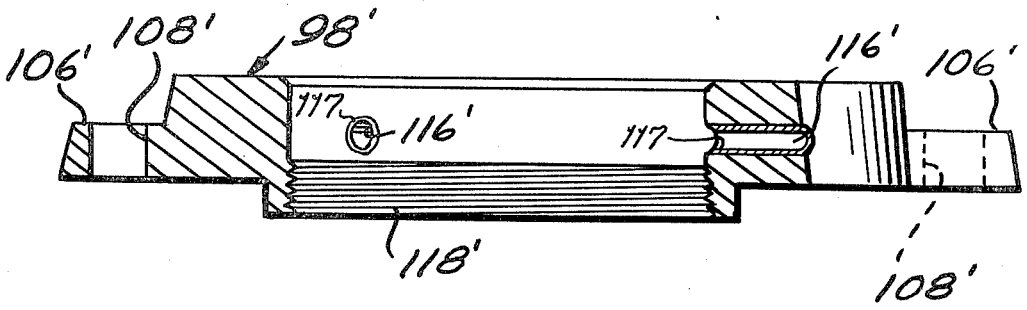
FIG. 22 is a sectional view taken on the line 22—22 of FIG. 21.

The major difference between the modification shown in FIGS. 19 through 23 and the invention shown in FIGS. 1 through 18 relates to the construction of the hydrant valve seat assembly 96. In this modification, the hydrant valve seat assembly 96' includes a valve seat ring 80 made of brass but instead of providing a housing member 98 which is made in two parts, namely, an annular housing ring 100 and an annular drain ring 102, the housing member 98' is an integral or one piece unit made from cast iron. The housing member 98' is best shown in FIGS. 21 through 23 inclusive and it will be noted that it is provided with an upper surface having an annular groove 120 for reception of an annular sealing ring 122. Also, the housing member 98' is also provided with internal threads 118' for mating with the threads 90 of the valve seat ring 80. The housing member 98' is further provided with a pair of oppositely disposed radially extending lugs or ears 106' having apertures 108' which are arranged to align with the apertures 50 in the flange 40 of the shoe 26. Bolt means 110 detachably retain the housing member 98' to the shoe 26.

The housing member 98' is provided with a pair of oppositely disposed drain passages 116', the drain passages 116' providing communication between the exterior of the hydrant and the annular drain manifold 92 of the valve seat ring 80, as well as the passages 136 in the valve seat ring 80. Since the housing member 98' is made of cast iron and it is highly desirable to have a corrosive-proof drain passage therethrough, the drain passage 116' is provided with a tubular sleeve 117 which may be either stainless steel or brass. Of course, the housing member 98' could be made of brass and if it is, then the sleeves 117 would not be necessary.

The hydrant disclosed in FIGS. 19 through 23 functions identically with that described with respect to FIGS. 1 through 18 and, therefore, a further description of either the removal of the barrel from the shoe with the housing valve seat assembly staying with the shoe or the removal of the shoe from the barrel with the housing valve seat assembly staying with the barrel will not be repeated since it would be repetitious.

The terminology used throughout the specification is for the purpose of description and not limitation as the scope of this invention is defined by the claims.

What is claimed is:

1. In a fire hydrant, the combination comprising: a barrel having a flanged lower end, a hydrant shoe having a flanged end with an upwardly opening mouth and another end arranged to be connected to a water main, means for detachably connecting the flanged lower end of said barrel to the flanged end of said shoe, an annular housing member sandwiched between the flanged lower end of said barrel and said flanged end of said shoe, means for detachably connecting said housing member to the flanged end of said shoe independent of said barrel and said first mentioned connecting means, said annular housing member having interior threads, a valve seat ring having exterior threads received in the interior threads of said housing member and having a downwardly facing annular valve seat, a valve stem extending upwardly through the mouth of said shoe and through said barrel and a valve element on the lower end of said stem seatable on said valve seat.

2. A fire hydrant as claimed in claim 1 in which said annular housing member includes an annular housing ring sandwiched between the flanged end of said shoe and the flanged lower end of said barrel, said housing ring having a radial inwardly extending flange, and an annular drain ring arranged to be positioned between the radial inwardly extending flange of the housing ring and the hydrant shoe, said drain ring being provided with the interior threads of said housing member and being provided with at least one drain passage therethrough.

3. A fire hydrant as claimed in claim 2 in which said housing ring is provided with at least two radial outwardly extending apertured lugs, and in which said means for detachably connecting said housing member to the flanged end of said shoe includes bolt means extending through the apertured lugs and through the flanged end of said shoe.

4. A fire hydrant as claimed in claim 3 in which said housing ring is provided with a generally radially extending cut-out therethrough and in which said drain ring is provided with a lug thereon for reception in said cut-out, said lug having the drain passage extending therethrough.

5. A fire hydrant as claimed in claim 4 including a drain passage extending through said valve seat ring and communicating with the drain passage in said drain ring, said drain passage of said valve seat ring being in open communication with the barrel interior when said valve element is closed and being closed when said valve element is opened.

6. A fire hydrant as claimed in claim 2 in which said drain ring is brass and which said valve seat ring is brass.

7. A fire hydrant as claimed in claim 5 including a first sealing means between said valve seat ring and said housing ring, a second sealing means between said valve seat ring and said shoe, said drain passage in said valve seat ring and said drain passage in said drain ring being positioned intermediate said first sealing means and second sealing means.

8. A fire hydrant as claimed in claim 7 including sealing means between said lower flanged end of said barrel and said housing ring, said sealing means including an annular groove in the surface of said housing ring which abuts the lower flanged end of said barrel and a sealing ring in said groove.

9. A fire hydrant as claimed in claim 5 in which said valve element includes a web structure movable therewith, said web structure having a drain valve facing strip made of polyethylene mounted thereon for cooperating with the drain passage in said valve seat ring to close the same when the valve element is opened, said polyethylene drain valve facing strip being moved out of alignment with said drain passage in said valve seat ring when said valve element is closed.

10. A fire hydrant as claimed in claim 9 in which said polyethylene drain valve facing strip is solid in cross-section.

11. A fire hydrant as claimed in claim 10 in which said polyethylene drain valve facing strip is provided on its face abutting said web structure with a plurality of dish-shaped recesses completely sealed from the interior of the hydrant barrel.

12. A fire hydrant as claimed in claim 9 in which said web structure includes at least two vertically extending ribs, and in which the interior of said valve seat ring is provided with longitudinally extending grooves for receiving the ribs to prevent the valve element from rotating, and in which said valve seat ring has at least two drain passages therein, each opening to one of said longitudinal grooves, said ribs each having a longitudinal dovetail groove therein, and in which there are two polyethylene drain valve facings, each having a cross-section complementary to said dovetail grooves so that they can be received and retained in said dovetail grooves.

13. A fire hydrant as claimed in claim 1 in which said housing member includes at least one drain passage therethrough and in which said valve seat ring includes at least one drain passage therethrough communicating with the passage in said housing member, and in which said valve element includes a web structure movable therewith, said web structure carrying at least one drain valve facing strip made of polyethylene for cooperating with the drain passage in said valve seat ring to close the same to the exterior of the hydrant when the valve element is opened, said polyethylene drain valve facing strip being moved out of alignment with said drain passage in said valve seat ring when said valve element is closed whereby water in said barrel can drain to the exterior of the hydrant.

14. A fire hydrant as claimed in claim 13 in which said polyethylene drain valve facing strip is solid in cross-section.

15. A fire hydrant as claimed in claim 13 in which said polyethylene drain valve facing strip is provided on its face abutting said web structure with a plurality of dish-shaped recesses completely sealed from the interior of the hydrant barrel.

16. A fire hydrant as claimed in claim 13 in which said web structure includes at least two vertically extending ribs and in which the interior of said valve seat ring is provided with longitudinally extending grooves for receiving the ribs to prevent the valve element from rotating, and in which said valve seat ring has at least two drain passages therein, each opening to one of said longitudinal grooves, said ribs each having a longitudinal dovetail groove therein, and in which there are at least two polyethylene drain valve facing strips each having a cross-section complementary to said dovetail grooves so that they can be received and retained therein.

17. A fire hydrant as claimed in claim 2 in which said housing member sandwiched between said flanged lower end of said barrel and the flanged end of said shoe is bolted only to said shoe and is retained in position on said barrel when said shoe is removed and said valve element is in the closed position.

18. A fire hydrant as claimed in claim 17 in which said housing member is an integral unit and includes a pair of radial lugs extending from the outer periphery of the same, said lugs being apertured to receive bolt means for retaining said housing member to said shoe independently of said barrel.

19. A fire hydrant as claimed in claim 18, including at least one drain passage in said housing member, at least one drain passage in said valve seat ring cooperating with the drain passage in said housing member, and in which said valve element includes a web structure having a polyethylene drain valve facing strip thereon, said web structure being movable with said valve element and said polyethylene drain valve facing strip being arranged to close the drain passage in said sealing ring when said valve element is in the opened position and to open said drain passage in the sealing ring when said valve element is in the closed position whereby the hydrant barrel can be drained of water.

20. A fire hydrant as claimed in claim 19 in which said polyethylene drain valve facing strip is solid in cross-section.

21. A fire hydrant as claimed in claim 19 in which said polyethylene drain valve facing strip is provided on its face abutting said web structure with a plurality of dish-shaped recesses completely sealed from the interior of the hydrant barrel.

22. A fire hydrant as claimed in claim 19 in which said valve seat ring is made of brass and in which said housing member is made of cast iron.

23. A fire hydrant as claimed in claim 22 including a brass tube carried in the drain passage of said housing member.

24. In a fire hydrant, the combination comprising: a barrel having a flanged lower end, a hydrant shoe having a flanged end with an outwardly opening mouth and another end arranged to be connected to a water main, a hydrant valve seat assembly positioned between the flanged lower end of said barrel and the flanged end of said shoe, said hydrant seat assembly including a valve seat ring having an annular downwardly facing valve seat, a valve stem extending upwardly through the mouth of said shoe and through said barrel, a valve element on the lower end of said stem and seatable on said valve seat, means detachably connecting the flanged lower end of said barrel to the flanged end of said shoe, and means detachably connecting said valve seat assembly to the flanged end of said shoe independently of said barrel whereby said barrel may be removed from said shoe without removing said valve seat assembly and said valve element from said shoe and whereby said shoe, when said last mentioned means are detached and said valve element is seated against said valve seat, may be removed from said barrel without removing said valve seat assembly from said barrel.

* * * * *